US006893111B2

(12) United States Patent
Herwald et al.

(10) Patent No.: US 6,893,111 B2
(45) Date of Patent: May 17, 2005

(54) IMAGING APPARATUS HAVING A PRINTHEAD CARRIER/BELT INTERFACE DEVICE

(75) Inventors: Marc Alan Herwald, Lexington, KY (US); Brian Andrew Naro, Lexington, KY (US); Bryan Christopher Scharf, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 109 days.

(21) Appl. No.: 10/264,713

(22) Filed: Oct. 3, 2002

(65) Prior Publication Data

US 2004/0066443 A1 Apr. 8, 2004

(51) Int. Cl.[7] ..... B41J 23/00
(52) U.S. Cl. ..... 347/37
(58) Field of Search ..... 347/37; 346/139 R, 346/139 B, 139 D; 400/335, 691, 319, 320, 352

(56) References Cited

U.S. PATENT DOCUMENTS

| | | | |
|---|---|---|---|
| 3,945,022 | A | 3/1976 | Distler |
| 4,573,368 | A | 3/1986 | Kobayashi |
| 4,795,285 | A | 1/1989 | Moriya et al. |
| 5,044,797 | A | 9/1991 | Walker et al. |
| 5,366,305 | A | 11/1994 | Christianson |
| 5,465,107 | A | 11/1995 | Mayo et al. |
| 5,595,448 | A | 1/1997 | Harada |
| 5,611,632 | A | 3/1997 | Hiramatsu et al. |
| 5,779,376 | A | 7/1998 | Seu |
| 5,924,809 | A | 7/1999 | Wotton et al. |
| 5,966,147 | A | 10/1999 | Matsui |
| 6,004,050 | A | 12/1999 | Rehman et al. |
| 6,030,067 | A | 2/2000 | Kawamura |
| 6,158,908 | A | 12/2000 | Yuge |
| 6,244,765 | B1 | 6/2001 | Harriman et al. |
| 6,305,780 | B1 | 10/2001 | Askren et al. |
| 6,310,638 | B1 | 10/2001 | Heiles et al. |
| 6,340,221 | B1 | 1/2002 | Driggers et al. |

OTHER PUBLICATIONS

Merriam–Webster's Collegiate Dictionary, Tenth Ed., 1997.*

* cited by examiner

*Primary Examiner*—Michael S. Brooke
(74) *Attorney, Agent, or Firm*—Taylor & Aust, P.C.

(57) ABSTRACT

An imaging apparatus includes a carrier housing having an attachment feature, a carrier belt to transmit a translation to the carrier housing in a bi-directional scanning direction; and an interface device interposed between and coupled to both the carrier housing and the carrier belt. The interface device includes a body having a wing and a base. The wing is defined by a span and by a chord length. At least one of the wing and the base is mounted via the attachment feature to the carrier housing. The span extends in the bi-directional scanning direction, and the chord length is substantially perpendicular to the span.

22 Claims, 12 Drawing Sheets

IMAGING APPARATUS HAVING A PRINTHEAD CARRIER/BELT INTERFACE DEVICE

BACKGROUND OF THE INVENTION

1. Field of the Invention

The present invention relates to an imaging apparatus, and, more particularly, to a printhead carrier vibration isolator.

2. Description of the Related Art

A typical imaging apparatus, such as an ink jet printer, forms an image onto a recording medium, such as paper or film, by causing an imaging substance to be deposited onto the recording medium. For example, an ink jet printer forms an image on a recording medium by selectively ejecting ink from a plurality of ink jetting nozzles of the printhead to form a pattern of ink dots on the recording medium. During ink jet printing, the printhead, mounted in a printhead carrier, is moved across the recording medium from one end to another in a scan direction by a carrier drive mechanism that includes a carrier belt, pulleys, and a motor. While the printhead is moving in the scan direction, ink is selectively ejected from the ink jetting nozzles to form a print swath. After completing at least one print swath, the recording medium is indexed a selected amount in a sub scan, i.e., paper feed, direction.

When the printhead is scanning across the recording medium, vibrations are developed in the printhead. These vibrations cause degradation of the image quality by producing a cyclic error that contributes to vertical banding, and is visible to the naked eye. One cause of such printhead vibration is torque ripple developed in the motor used to drive the printhead carrier back and forth across the recording medium. The torque ripple sets up vibratory modes in the carrier belt, which transfers the vibratory energy to the printhead carrier. The torque ripple, in conjunction with the carrier drive mechanism, also causes the torque of the motor to fluctuate, which produces a fluctuation in the force driving the printhead carrier, also yielding vertical banding.

Schemes for reducing such registration error have been attempted, for example, by the use of springs. However, springs alone may not provide sufficient damping to adequately absorb or isolate the offending frequency. In addition, damper inserts have been utilized, but these inserts may not provide sufficient damping at the low frequencies associated with carrier drive torque ripple. Also, some of these schemes may not provide sufficient rigidity, thereby affecting carrier drive control system response. Further, at least some of these schemes tend to involve a significant number of parts, thus increasing the cost and complexity of the printhead carrier and drive mechanism.

What is needed in the art is an apparatus for damping the vibratory modes in a printhead carrier and drive mechanism, particularly at low vibration frequencies.

SUMMARY OF THE INVENTION

The present invention provides an imaging apparatus having a printhead carrier/belt interface device for damping the vibratory modes in a printhead carrier and drive mechanism, particularly at low vibration frequencies.

The invention, in one form thereof, is directed to an imaging apparatus. The imaging apparatus includes a carrier housing having an attachment feature, a carrier belt to transmit a translation to the carrier housing in a bi-directional scanning direction, and an interface device interposed between and coupled to both the carrier housing and the carrier belt. The interface device includes a body having a wing and a base. The wing is defined by a span and by a chord length. At least one of the wing and the base is mounted via the attachment feature to the carrier housing. The span extends in the bi-directional scanning direction, and the chord length is substantially perpendicular to the span.

The invention, in another form thereof, is directed to an imaging apparatus including a carrier housing including an attachment feature, a carrier belt to transmit a translation to the carrier housing in a bi-directional scanning direction, and an interface device interposed between and coupled to both the carrier housing and the carrier belt. The interface device includes a body having an opening and a belt attach arm. The belt attach arm has a beam having a first end and a second end, a head formed at the first end, and a clamp for attachment to the carrier belt formed at the second end. The beam and the head are slidably received into the opening.

The invention, in still another form thereof, is directed to an interface device to isolate vibration for use in an imaging apparatus. The interface device includes a body. The body includes a central portion, a first wing and a second wing. The central portion has a first surface spaced apart from a second surface, and has an opening extending between the first surface and the second surface. The first wing extends in a first direction from the central portion. The second wing extends in a second direction opposite the first direction from the central portion. Each of the first wing and the second wing is defined by a span and a chord length. The chord length extends in a direction substantially perpendicular to the span.

An advantage of the present invention is the ability to damp vibratory energy, including low frequency vibrations associated with carrier motor torque ripple, and which may include both longitudinal and transverse standing waves in a carrier belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
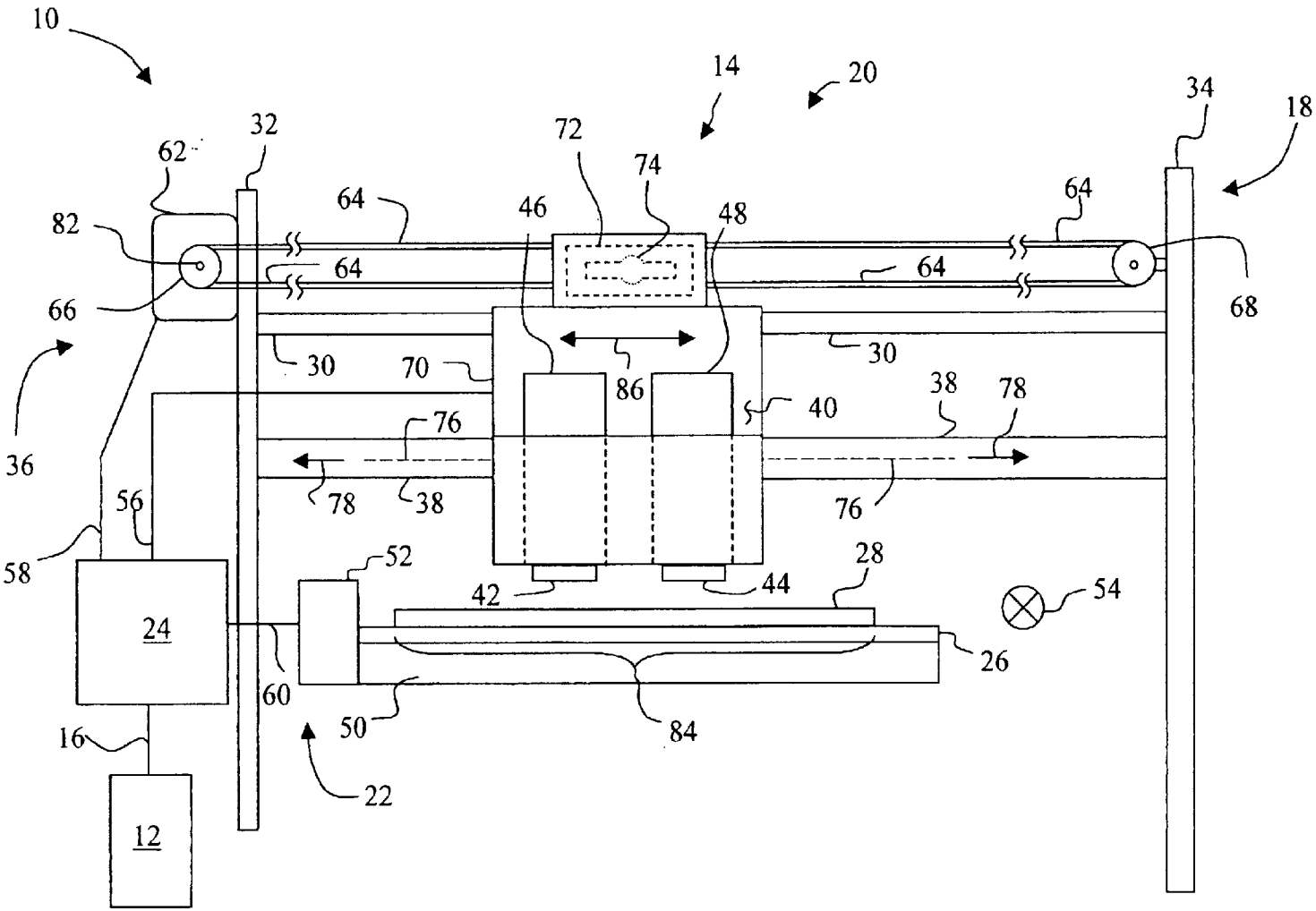
FIG. 1 is a diagrammatic representation of an imaging apparatus embodying the present invention.

Referring now to the drawings and particularly to FIG. 1, there is shown an imaging apparatus 10 embodying the present invention. Imaging apparatus 10 includes a computer 12 and an imaging device in the form of an ink jet printer 14. Computer 12 is communicatively coupled to ink jet printer 14 via a communications link 16. Communications link 16 may be, for example, a direct electrical or optical connection, or a network connection.

Computer 12 is typical of that known in the art, and includes a display, input devices such as a mouse and/or a keyboard, a processor, and associated memory. Resident in the memory of computer 12 is printer driver software. The printer driver software places print data and print commands in a format that can be recognized by ink jet printer 14.

Ink jet printer 14 includes a frame 18, a printhead carrier system 20, a feed roller unit 22, a controller 24, and a mid-frame 26. Ink jet printer 14 is used for printing on a recording medium 28.

Frame 18 includes a cross member 30, frame side 32, and frame side 34.

Printhead carrier system 20 includes a carrier drive system 36, a carrier shaft 38, and a printhead carrier 40 that carries a color printhead 42, and a black printhead 44, for printing on recording medium 28. Carrier shaft 38 is coupled to frame 18 via frame sides 32, 34. A color ink jet reservoir 46 is provided in fluid communication with color printhead 42, and a black ink reservoir 48 is provided in fluid communication with black printhead 44. Printhead carrier system 20, including color printhead 42 and black printhead 44, may be configured for unidirectional printing or bi-directional printing.

Feed roller unit 22 includes an index roller 50 and corresponding index pinch rollers (not shown). Index roller 50 is driven by a drive unit 52. The pinch rollers apply a biasing force to hold the sheet of recording medium 28 in contact with respective driven index roller 50. Drive unit 52 includes a drive source, such as, for example, a stepper motor and an associated drive mechanism, such as a gear train or belt/pulley arrangement. Feed roller unit 22 feeds recording medium 28 in a feed direction 54. As shown in FIG. 1, feed direction 54 is depicted as an X within a circle to indicate that the feed direction 54 is in a direction perpendicular to the plane of FIG. 1, toward the reader.

Controller 24 is electrically connected to color printhead 42, and black printhead 44 via an interface cable 56. Controller 24 is electrically connected to carrier drive system 36 via interface cable 58, and to drive unit 52 via interface cable 60.

Controller 24 includes a microprocessor having an associated random access memory (RAM) and read only memory (ROM). Controller 24 executes program instructions to effect the printing of an image on the sheet of recording medium 28, such as coated paper, plain paper, photo paper, or transparency, located on mid-frame 26.

Carrier drive system 36 includes a carrier motor 62, a carrier belt 64, a carrier pulley 66, and an idler pulley 68. Printhead carrier 40 includes a carrier housing 70. Carrier housing 70 includes an attachment feature 72. An interface device 74 is interposed between carrier belt 64 and carrier housing 70, and engages attachment feature 72.

Printhead carrier 40 is guided by carrier shaft 38 and cross member 30. Printhead carrier 40 is slidably coupled to carrier shaft 38, and is slidably coupled to cross member 30. A carrier shaft centerline 76 of carrier shaft 38 defines a bi-directional scanning direction 78 for printhead carrier 40. Bi-directional scanning direction 78 is perpendicular to feed direction 54.

Carrier belt 64 is driven by carrier motor 62 via a carrier pulley 66, and is supported by an idler pulley 68. Carrier belt 64 serves to transmit translation to printhead carrier 40, via interface device 74, in a reciprocating manner along carrier shaft 38 and cross member 30 in bi-directional scanning direction 78. Carrier motor 62 and idler pulley 68 are affixed to frame side 32 and frame side 34, respectively, of frame 18. Carrier motor 62 can be, for example, a direct current (DC) motor or a stepper motor, and is coupled to carrier pulley 66 via a carrier motor shaft 82.

The reciprocation of printhead carrier 40 transports ink jet color printhead 42 and black printhead 44 across a sheet of recording medium 28, such as paper or film, in bi-directional scanning direction 78 to define a print zone 84 of ink jet printer 14. This reciprocation occurs in a main scan direction 86 that is parallel with bi-directional scanning direction 78, and is also commonly referred to as the horizontal direction.

Interface device 74 is interposed between and coupled to both carrier housing 70 and carrier belt 64 to isolate printhead carrier 40 from vibrations associated with carrier drive system 36. One embodiment of interface device 74 and attachment feature 72 of carrier housing 70, shown in FIG. 1, will be described below in relation to FIGS. 3–7. Another embodiment of interface device 74 and attachment feature 72 of carrier housing 70, shown in FIG. 1, will be described below in relation to FIGS. 8–10. Two other embodiments will be described in relation to FIGS. 11 and 12, respectively.

Figure 2:
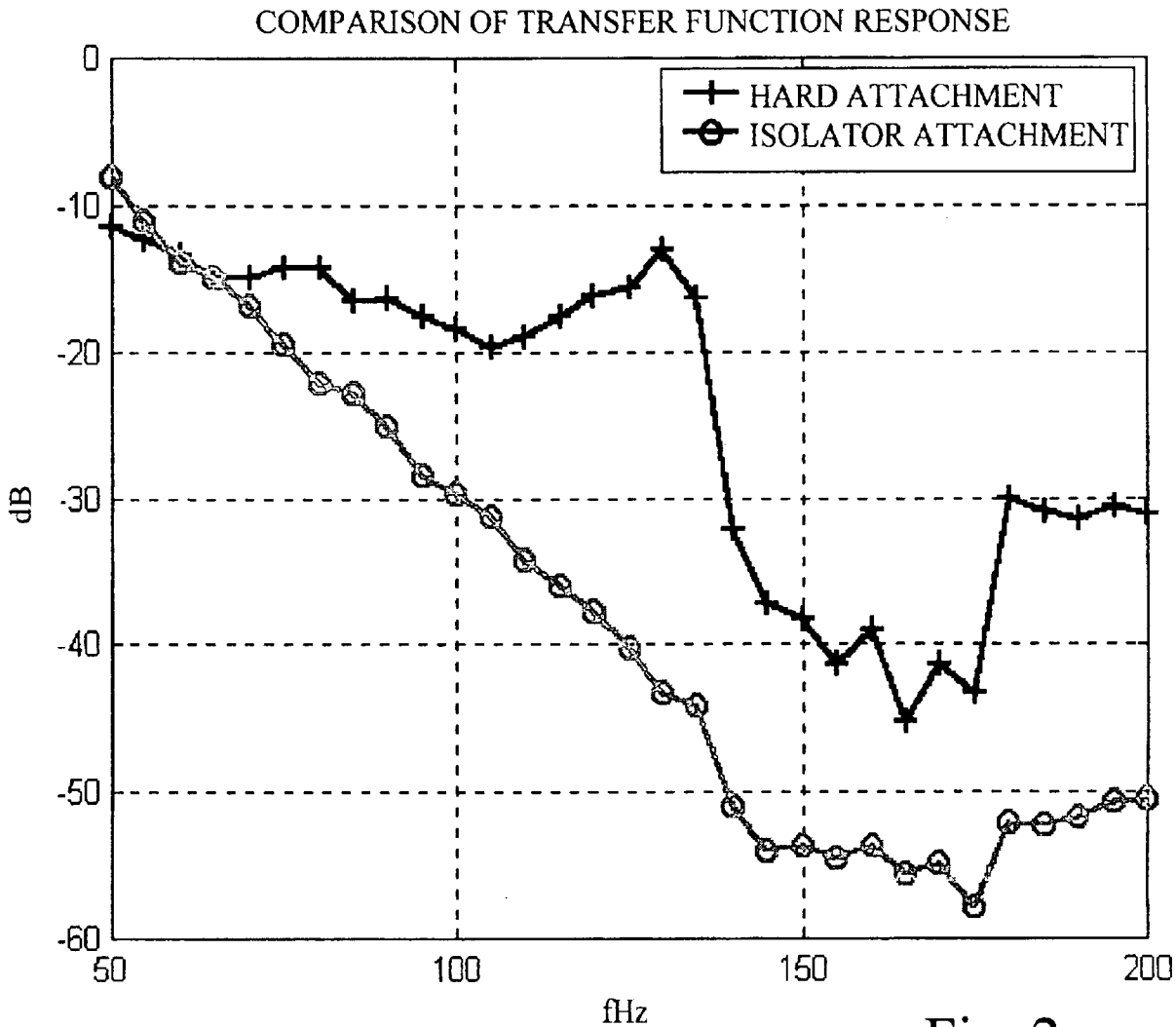
FIG. 2 is a general plot showing vibration transfer response of a hard attachment between a carrier housing and a carrier belt versus an isolator attachment between the same, such as the interface device of the present invention.

FIG. 2 is a general plot depicting a vibration transfer to a carrier configuration wherein a hard attachment is provided between a carrier housing and a carrier belt, versus a vibration transfer response to a carrier configuration as in FIG. 1, wherein an isolator attachment via interface device 74 is provided between carrier housing 70 and carrier belt 64. As shown, the use of interface device 74 provides a significant reduction in the magnitude of the vibration transfer response, particularly at low frequencies, for example, between 70 hertz and 200 hertz as depicted in FIG. 2.

Figure 3:
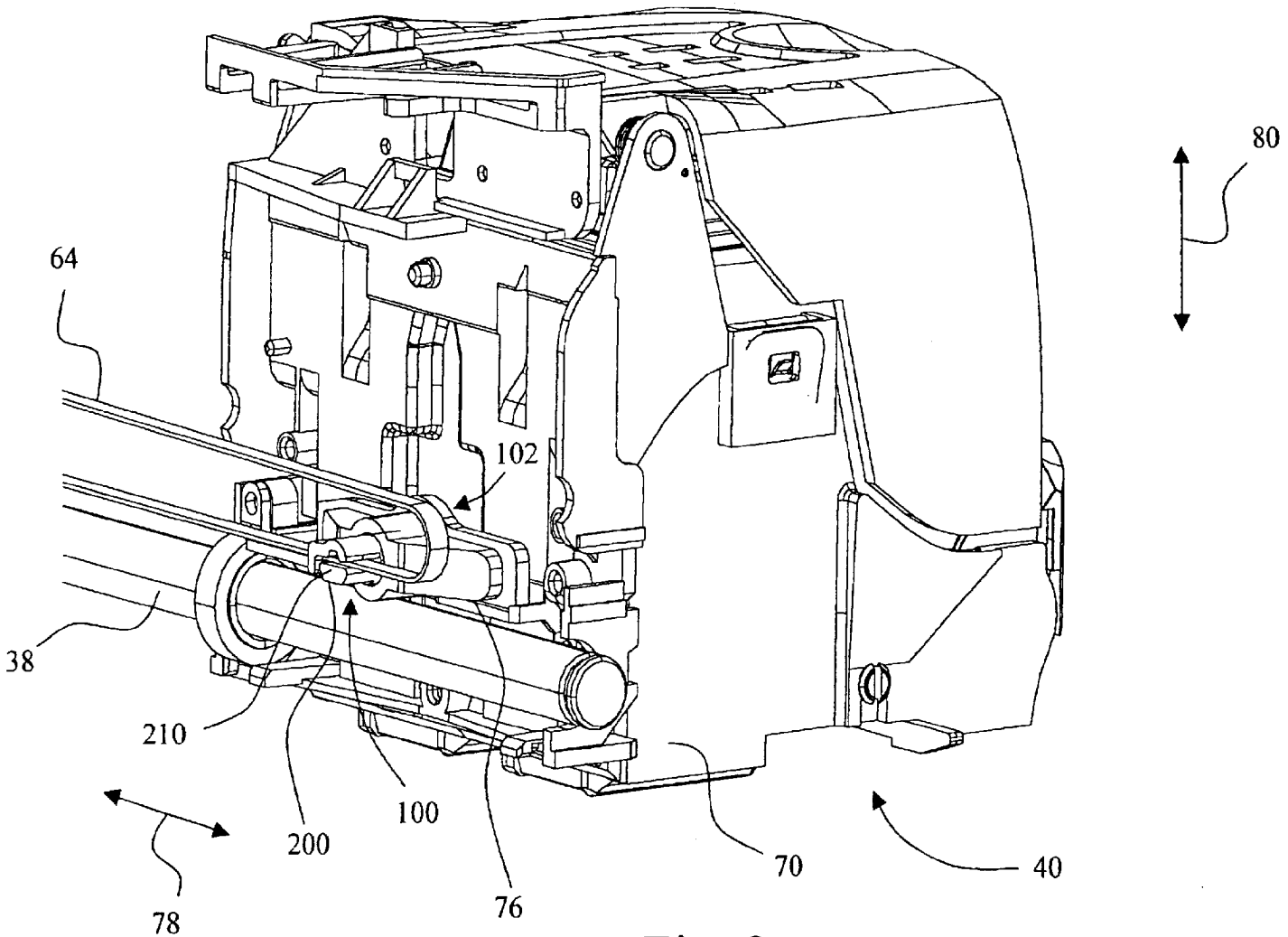
FIG. 3 is a perspective view of a printhead carrier including an interface device of the present invention.

Referring to FIG. 3, in one embodiment, there is shown an interface device 100, suitable for use as interface device 74, and an attachment feature 102, suitable for use as attachment feature 72.

As shown in FIG. 3, interface device 100 includes a body 104 and a belt attach arm 200.

Figure 4:
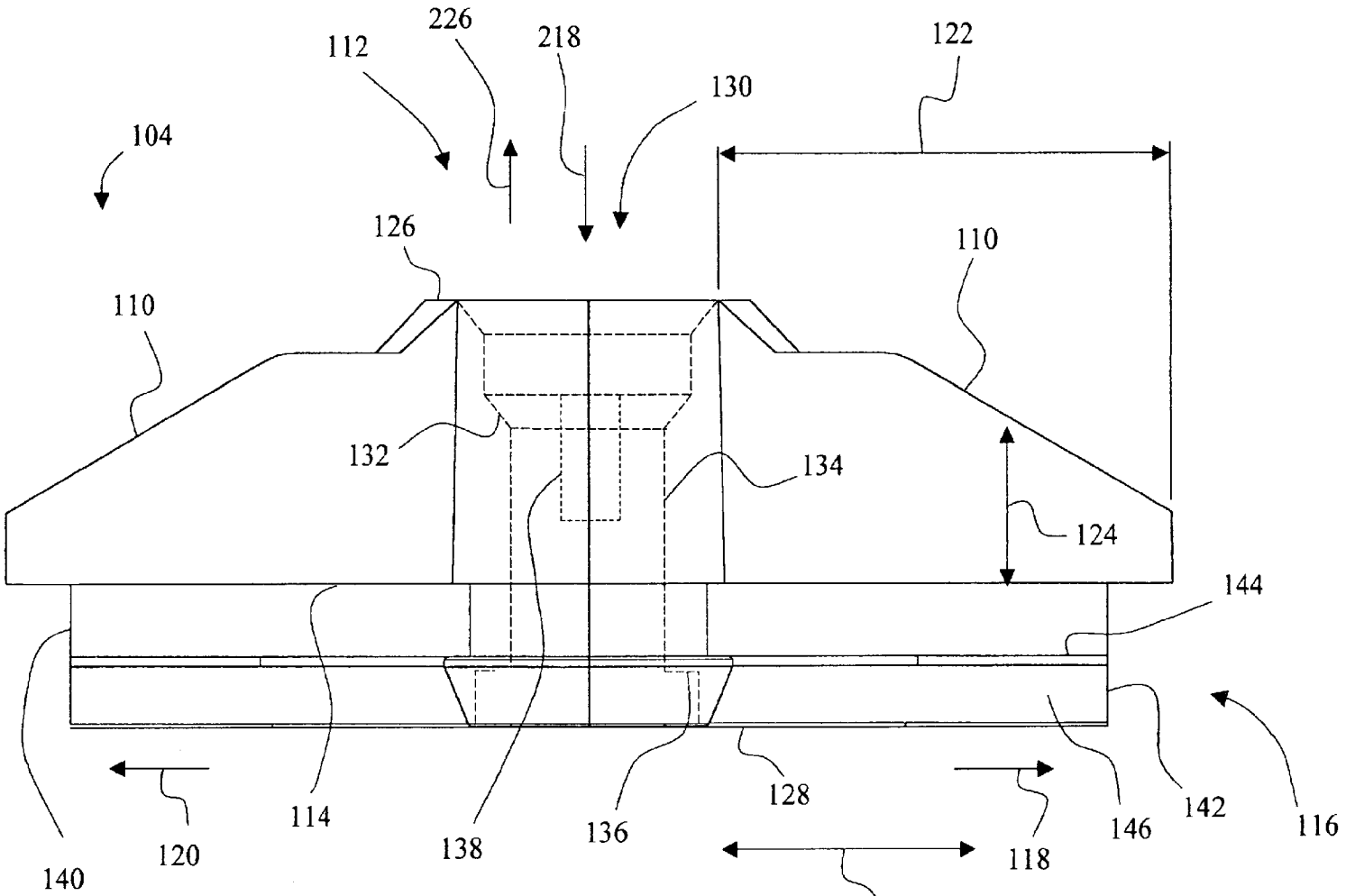
FIG. 4 is a top view of the body of the interface device of FIG. 3.

Referring now to FIG. 4, body 104 has two wings 110, a central portion 112, and a base 114. Base 114 includes a base mounting feature 116. Base 114 is mounted to carrier housing 70 via base mounting feature 116 and attachment feature 102. A first of wing 110 extends in a first direction 118 from central portion 112, and a second of wing 110 extends from central portion 112 in a second direction 120 opposite to direction 118. Each of wing 110 and central portion 112 extend from base 114. Each wing 110 is defined by a span 122 and a chord length 124. Span 122 extends in bi-directional scanning direction 78. Chord length 124 is substantially perpendicular to span 122 and varies in magnitude along span 122 of wing 110. The variation of chord length 124 with respect to span 122 may be described, such as, for example, by a polynomial function, an exponential function, or a combination function that includes linear and/or non-linear components. The variation of chord length 124 with respect to span 122 of the embodiment shown in FIG. 4 may be approximated by the combination function that includes a linear function with a slope equal to zero extending in a direction away from body 104, followed by a linear function with a non-zero slope extending in a direction away from body 104. As shown, span 122 is greater in magnitude than chord length 124.

Central portion 112 of body 104 has an exterior surface 126 spaced apart from an exterior surface 128, and an opening 130. Opening 130 extends between exterior surface 126 and exterior surface 128. Within opening 130 are a beveled face surface 132, a barrel portion 134, a flat face surface 136, and a keyway 138. Barrel portion 134 extends between beveled face surface 132 and flat face surface 136. Keyway 138 extends along the longitudinal dimension of barrel portion 134.

Figure 5:
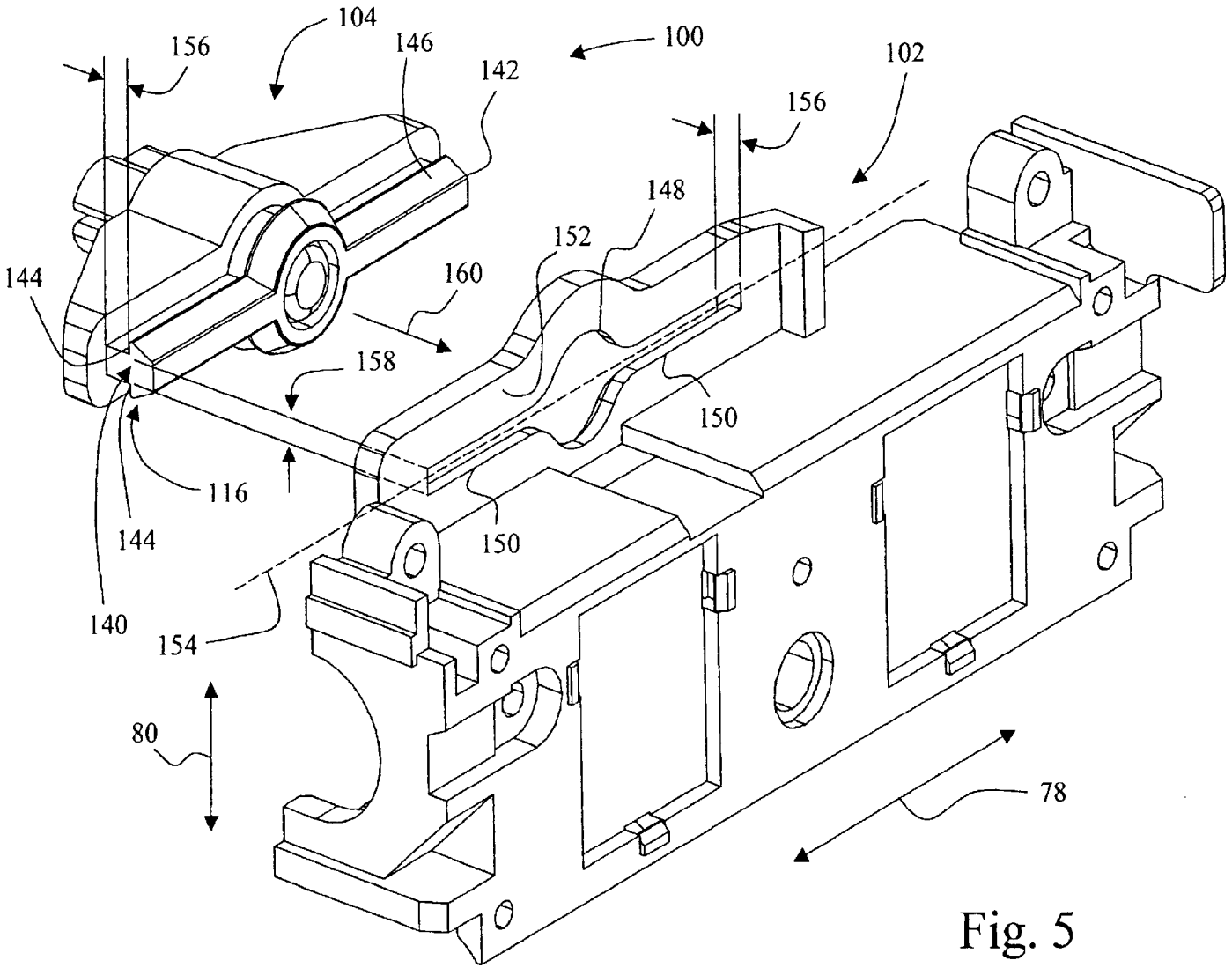
FIG. 5 is an exploded view of the interface device of FIG. 3 in relation to an attachment feature of the carrier housing.

Referring also to FIG. 5, interface device 100 is depicted with base mounting feature 116 in aligned proximity to attachment feature 102 of carrier housing 70. Base mounting feature 116 of interface device 100 includes an extension 140 that extends from base 114, and more particularly, extends from wings 110 and central portion 112. Extension 140 includes a ramped keeper head 142. Ramped keeper head 142 has a keeper face 144 and a ramp surface 146. Keeper face 144 extends outward from extension 140. Extension 140 is configured to engage attachment feature 102.

Attachment feature 102 includes an aperture 148, two slots 150, and a retention face 152. The two slots 150 of attachment feature 102 extend radially outward from aperture 148 about one hundred eighty degrees apart from each other, and retention face 152 is adjacent to aperture 148 and two slots 150. The two slots 150 have a common axis 154 that is substantially parallel to bi-directional scanning direction 78. Aperture 148, two slots 150, and retention face 152 of attachment feature 102 serve to engage with extension 140, ramped keeper head 142, and keeper face 144 of base mounting feature 116. In order to retain a secure and vibration resistant engagement between interface device 100 and carrier housing 70, extension 140 of base mounting feature 116 has an interference fit in at least two dimensions 156 and 158 with respect to aperture 148 and two slots 150 of attachment feature 102.

Base mounting feature 116 of interface device 100 and attachment feature 102 of carrier housing 70 are configured such that a translation of interface device 100 in a first translational direction 160 results in extension 140 of base 114 being slidably received into aperture 148 and slots 150 under the aid of ramped keeper head 142, with keeper face 144 of ramped keeper head 142 engaging retention face 152 to resist removal of interface device 100 from engagement with carrier housing 70.

Once body 104 is mounted to carrier housing 70, belt attach arm 200 is inserted into opening 130 of body 104.

Figure 6:
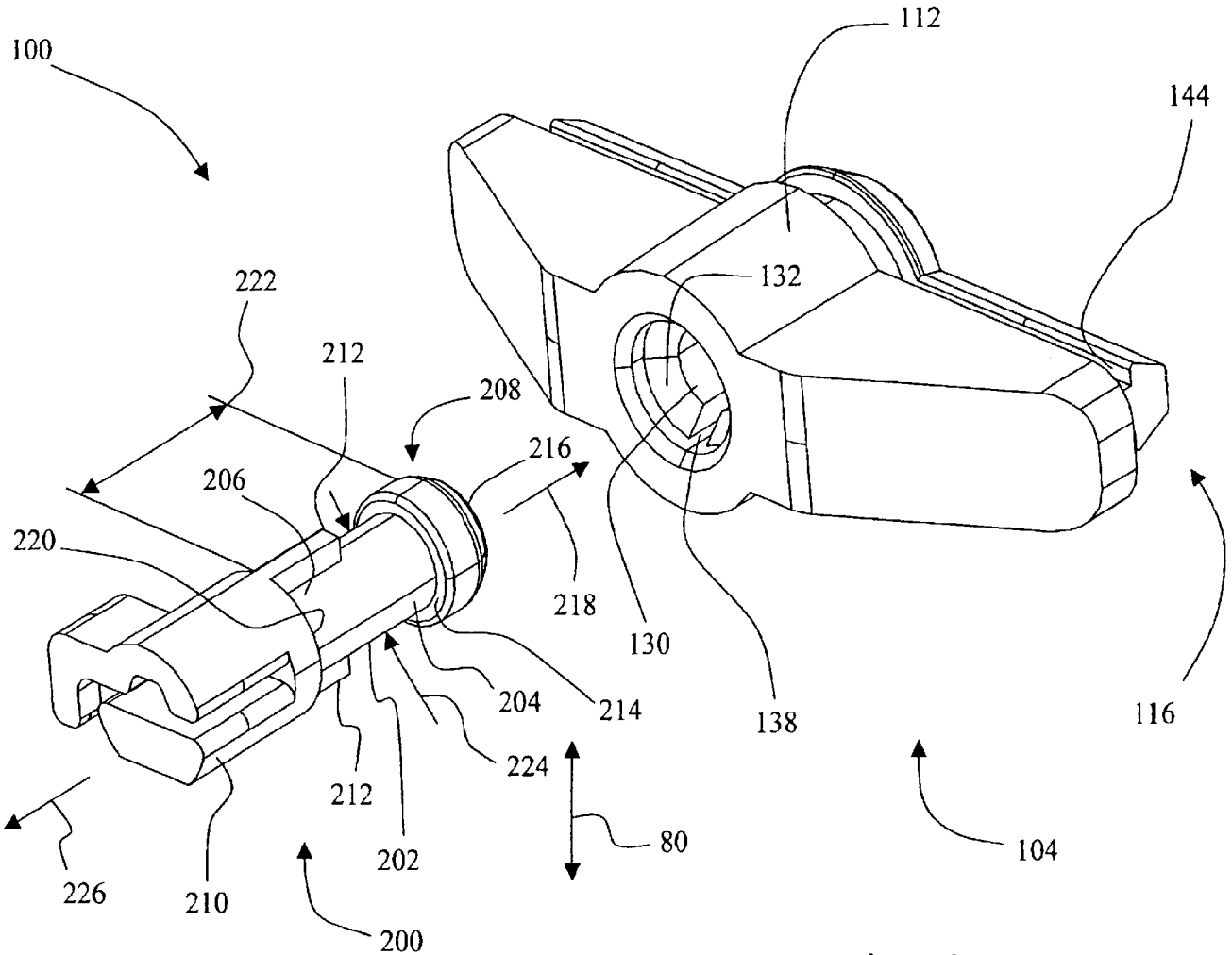
FIG. 6 is an exploded view of the interface device FIG. 3.

Referring now to FIG. 6, belt attach arm 200 of interface device 100 is depicted in aligned proximity to body 104 of interface device 100. Belt attach arm 200 includes a beam 202 having a first end 204 and a second end 206, with a head 208 formed at first end 204, a clamp 210 formed at second end 206, and also includes a key 212. Head 208 includes a retention shoulder 214 and a ramped surface 216, head 208 narrowing at ramped surface 216 away from retention shoulder 214 in a first direction 218. Clamp 210 includes a retention shoulder 220. Clamp 210 is configured for attachment to carrier belt 64. Head 208 and clamp 210 are larger in a major dimension than opening 130 in central portion 112 of body 104. Opening 130 is configured such that when head 208 and beam 202 are inserted in first direction 218 into opening 130, head 208 resists removal of beam 202 from opening 130. Referring to FIG. 4, in order to retain a secure and vibration resistant engagement between belt attach arm 200 and body 104, belt attach arm 200 has an interference fit in at least two dimensions 222 and 224 with barrel portion 134 of body 104. Keyway 138 of body 104 is configured for receiving key 212 of belt attach arm 200, wherein keyway 138 receives key 212 to resist a rotation of belt attach arm 200 relative to body 104.

Assembly of interface device 100 with ink jet printer 14 is now described. Referring again to FIG. 5, base mounting feature 116 of interface device 100 is aligned with aperture 148 and slots 150 of attachment feature 102, and body 104 of interface device 100 is pushed in direction 160 towards carrier housing 70 by an assembly tool (not shown). An assembly force is applied to body 104 in direction 160, engaging ramped keeper head 142 with aperture 148 and slots 150. Ramped keeper head 142 deflects as ramp surface 146 of ramped keeper head 142 engages aperture 148 and slots 150, compressing ramped keeper head 142. The deflection of ramped keeper head 142 allows extension 140 and ramped keeper head 142 of base 114 to enter into aperture 148 and slots 150. Force is applied until ramped keeper head 142 exits aperture 148 and slots 150, at which time ramped keeper head 142 is no longer held in compression by aperture 148 and slots 150. Ramped keeper head 142 thus returns to a substantially undeflected state, exposing keeper face 144. Keeper face 144 serves to engage retention face 152 to prevent accidental removal of body 104 from engagement with carrier housing 70.

An alternative assembly of base mounting feature 116 of body 104 to attachment feature 102 is as follows. An outermost portion of base mounting feature 116 adjacent to one of wings 110 is inserted through aperture 148 along common axis 154 to engage one of slots 150. Assembly force is applied to push the wing 110 so that a corresponding portion of extension 140 is fully engaged with the slot 150. Then, body 104 is deformed, or bent, so that an outermost portion of base mounting feature 116 adjacent to the other of wings 110 may be inserted through aperture 148 along common axis 154 to engage the other of slots 150. Once inserted, an assembly force is applied to body 104 in direction 160, engaging a center portion of ramped keeper head 142, adjacent to central portion 112, with aperture 148. Force is applied until ramped keeper head 142 exits aperture 148. Body 104 is retained in engagement with carrier housing 70 as previously described.

Once body 104 is engaged with carrier housing 70, belt attach arm 200 is inserted in direction 218 (see FIG. 6) into opening 130 of body 104. As an assembly force is applied to belt attach arm 200 in direction 218, head 208 and beam 202 enter opening 130 aided by ramped surface 216, with opening 130 deflecting to receive head 208. Once head 208 has passed through opening 130, opening 130 returns to a substantially undeflected state, with barrel portion 134 restraining beam 202 via the interference fit at dimension 224 of beam 202. Retention shoulder 214 engages flat face surface 136 to resist movement or removal of belt attach arm 200 from body 104 in a direction 226 opposite to direction 218. Retention shoulder 220 of clamp 210 engages beveled face surface 132 to resist movement or removal of belt attach arm 200 from opening 130 in direction 218. Clamp 210 of belt attach arm 200 is then attached to carrier belt 64.

Figure 7:
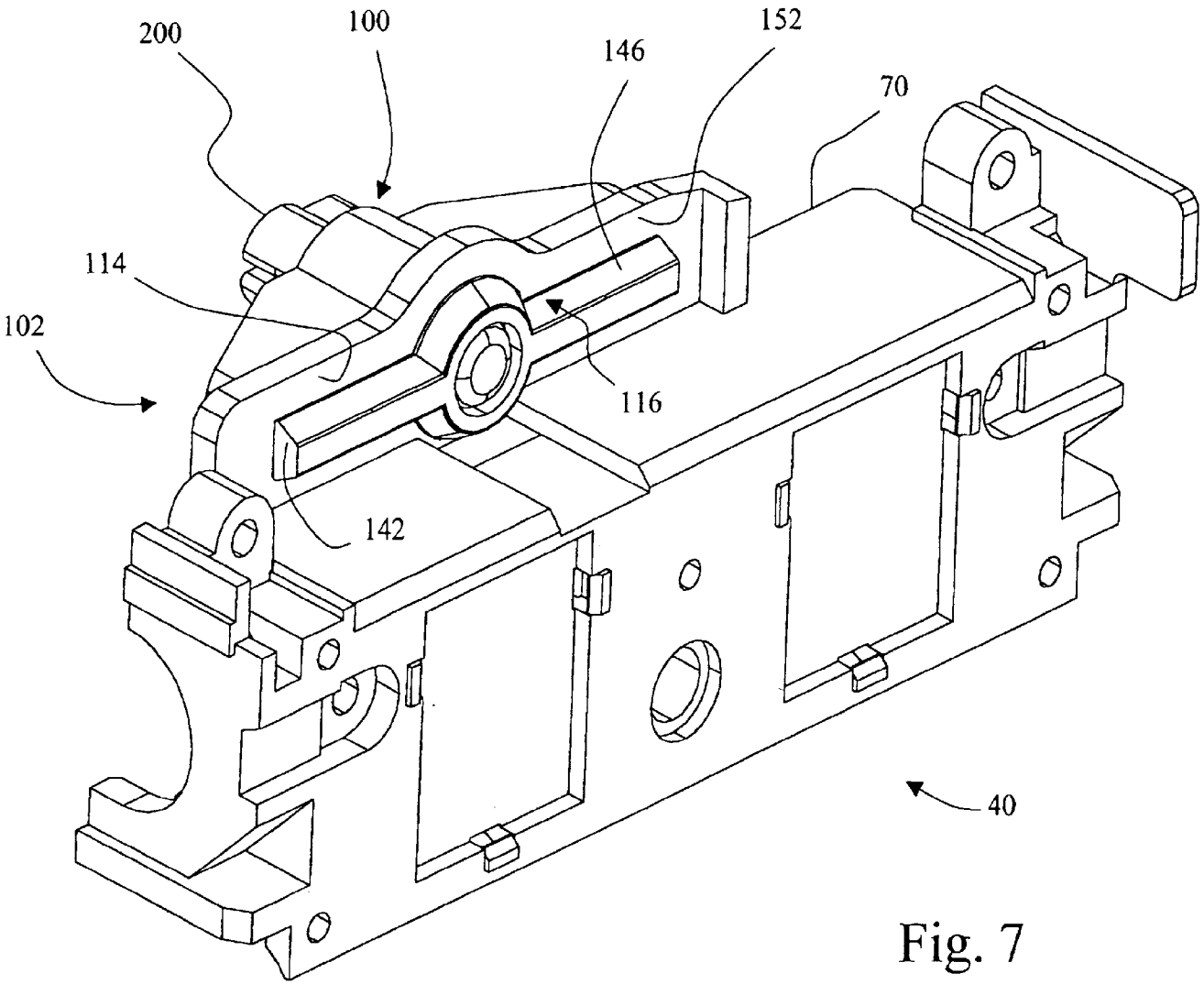
FIG. 7 represents the embodiment as depicted in FIG. 5 with the interface device engaged with the attachment feature.

Referring now to FIG. 7, base mounting feature 116 of base 114 is depicted in engagement with attachment feature 102 when interface device 100 is mounted to carrier housing 70.

Figure 8:
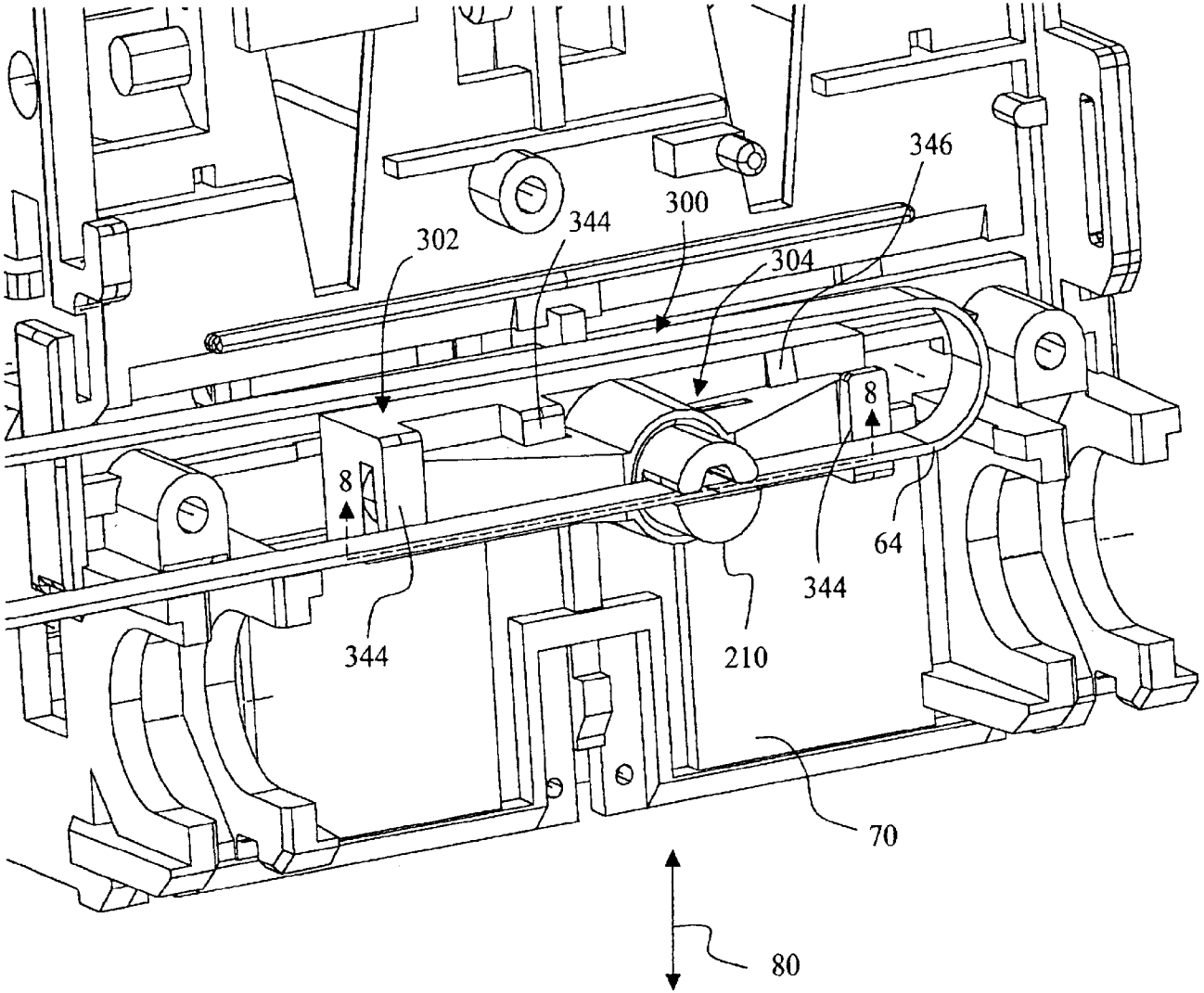
FIG. 8 is a perspective view of another embodiment of a printhead carrier and interface device of the present invention.
Figure 9:
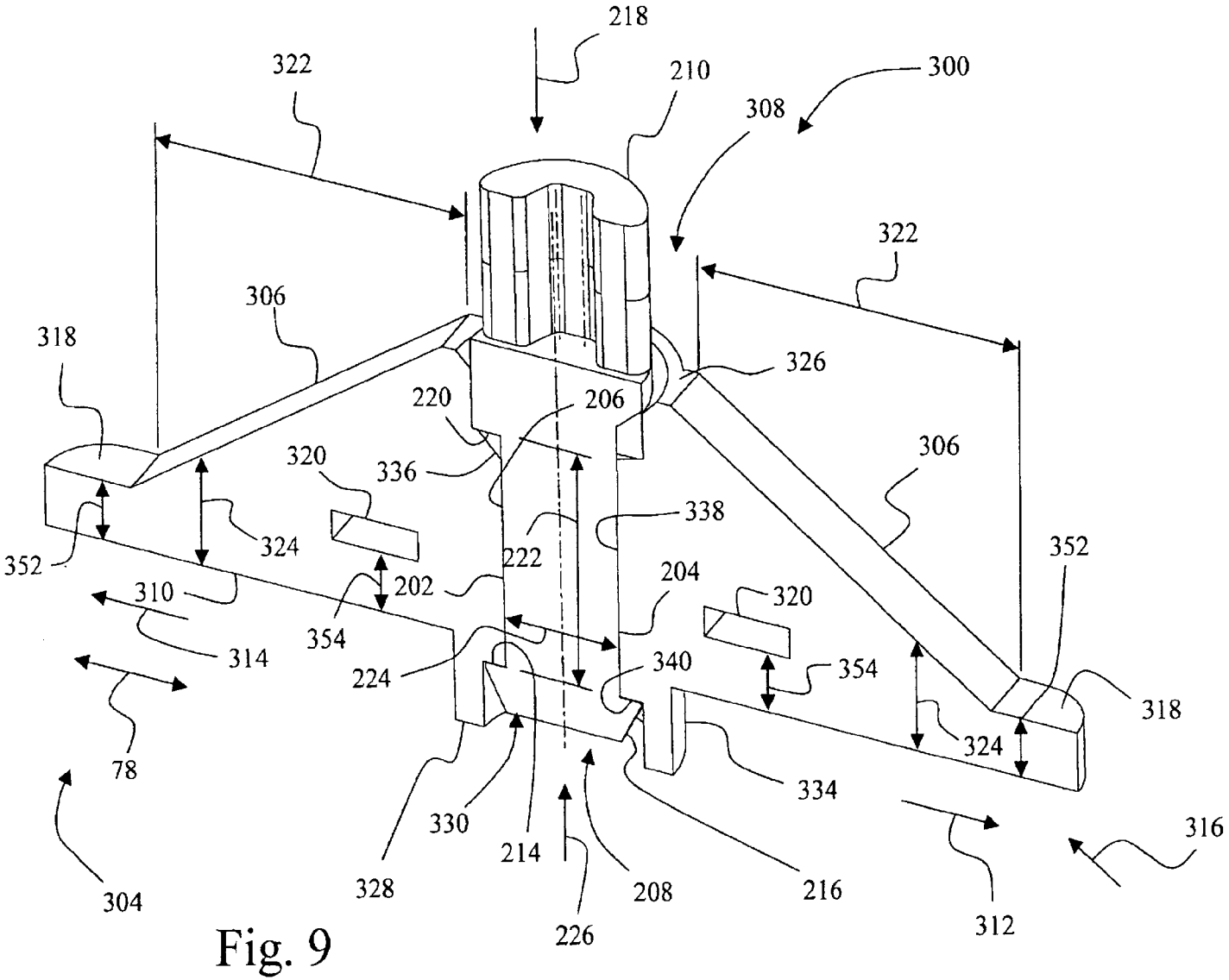
FIG. 9 shows the interface device of FIG. 8 in cross section.
Figure 10:
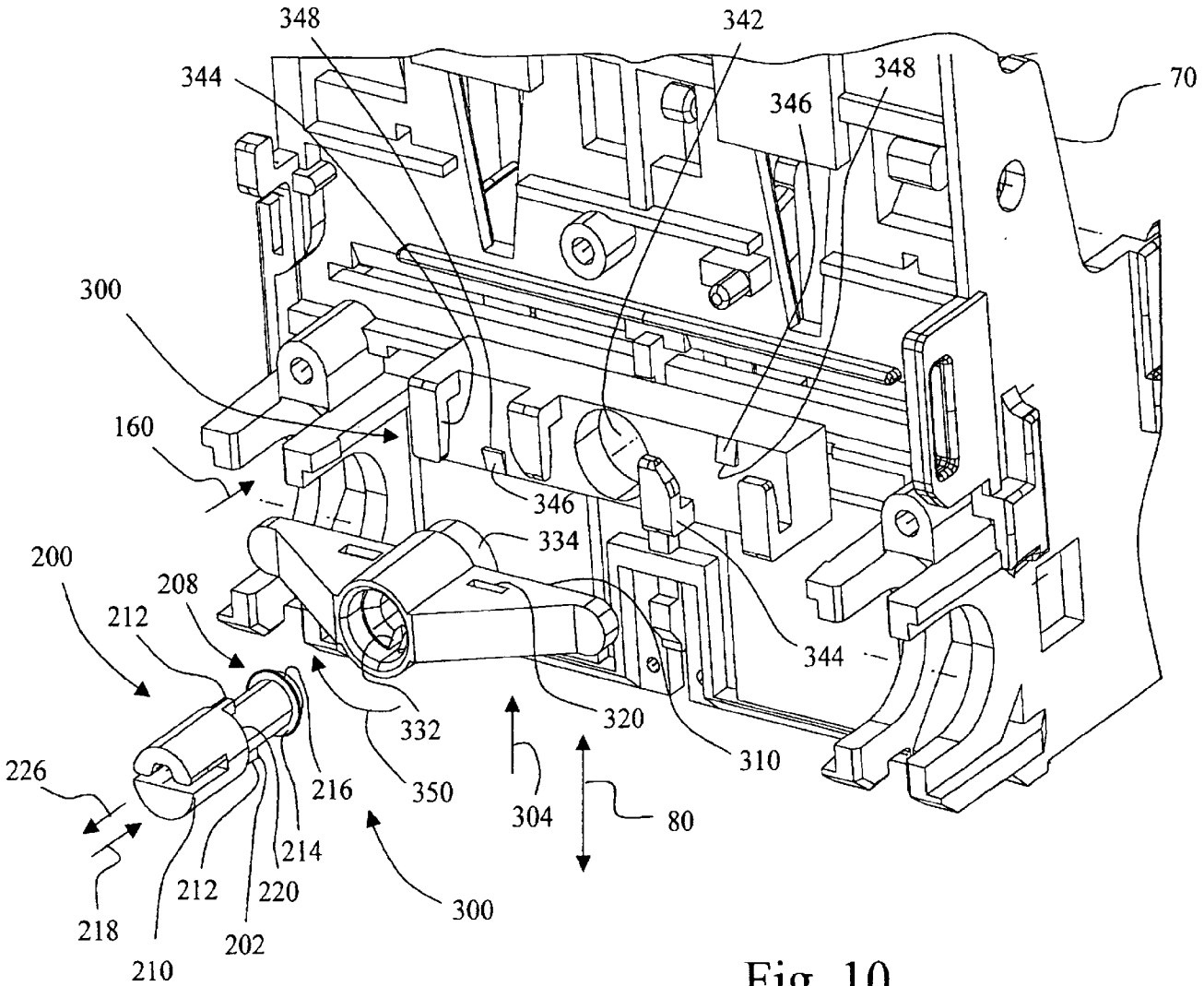
FIG. 10 is an exploded view of the interface device of FIG. 8 shown in alignment with another attachment feature of the present invention.

With reference to FIGS. 8, 9, and 10, another embodiment showing an interface device 300 and an attachment feature 302 suitable for use as interface device 74 and attachment feature 72, respectively, is depicted. Some of the features and components of this embodiment, in particular, belt attach arm 200, are common with the previously described embodiment.

Referring now to FIG. 8, interface device 300 is mounted to carrier housing 70. Interface device 300 includes a body 304 and belt attach arm 200. In order to aid in understanding the present embodiment, FIG. 9 is a cross section of interface device 300 of FIG. 8.

As shown in FIG. 9, body 304 has two wings 306, a central portion 308, and a base 310. Central portion 308 is interposed between wings 306. A first of wing 306 extends in a first direction 312 from central portion 308, and a second of wing 306 extends in a second direction 314 opposite to direction 312 from central portion 308. Wings 306 and central portion 308 extend from base 310.

Each wing 306 includes a wing mounting feature 316. Wing mounting feature 316 includes a hold-down flat 318 and a hold-down aperture 320. Each wing 306 is defined by a span 322 and a chord length 324. Span 322 extends in bi-directional scanning direction 78. Chord length 324 is substantially perpendicular to span 322 and varies linearly in magnitude along span 322 of wing 306, yielding substantially a triangular shape of wing 306. As shown, span 322 is greater in magnitude than the longest chord length 324.

Referring to FIGS. 9 and 10 central portion 308 of body 304 has an exterior surface 326 spaced apart from an exterior surface 328, an opening 330, a keyway 332 located in opening 330, and a protrusion 334. Opening 330 extends between exterior surface 326 and exterior surface 328. Opening 330 includes a beveled face surface 336, a barrel portion 338 and a flat face surface 340.

Belt attach arm 200 of interface device 300 includes beam 202 having first end 204 and second end 206, with head 208 formed at first end 204, clamp 210 formed at second end 206, and key 212. Head 208 includes retention shoulder 214 and ramped surface 216, head 208 narrowing at ramped surface 216 away from retention shoulder 214 in first direction 218. Clamp 210 is configured for attachment to carrier belt 64. Head 208 and clamp 210 are larger in a major dimension than opening 330 in central portion 308 of body 304. Opening 330 is configured such that when head 208 and beam 202 are inserted in first direction 218 into opening 330, head 208 resists movement or removal of beam 202 from opening 330. In order to retain a secure and vibration resistant engagement between belt attach arm 200 and body 304, belt attach arm 200 has an interference fit in at least two dimensions 222 and 224 with barrel portion 338 of body 304. Keyway 332 of body 304 is configured for receiving key 212 of belt attach arm 200, wherein keyway 332 receives key 212 to resist a rotation of belt attach arm 200 relative to body 304.

Referring now to FIG. 10, interface device 300 is depicted in aligned proximity with attachment feature 302 of carrier housing 70. Attachment feature 302 includes a cavity 342, hooks 344 (four, as shown) and a ramped keeper 346 having a keeper face 348. Cavity 342 is configured such that protrusion 334 of body 304 is slidably received into cavity 342 to guide interface device 300 relative to carrier housing 70 and attachment feature 302. Interface device 300 with wing mounting feature 316, and attachment feature 302 are configured such that a rotation in a first rotational direction 350 of interface device 300 results in hold-down flat 318 and hold-down aperture 320 of each wing 306, engaging respective ones of hooks 344. Each wing 306 is held in position by the corresponding keeper face 348 of ramped keeper 346 after wing 306 passes over the respective ramped keeper 346. In order to retain a secure and vibration resistant engagement between interface device 300 and carrier housing 70, wing mounting feature 316 of each wing 306 has an interference fit in at least two dimensions 352 and 354 with attachment feature 302, as illustrated in FIG. 9. Hooks 344, and the engagement of hold-down flat 318 and hold-down aperture 320 of each wing 306, with respective ones of hooks 344 provide an increased stiffness in bi-directional scanning direction 78 to provide for acceptable control response of carrier housing 70 in said bi-directional scanning direction 78.

Assembly of interface device 300 with ink jet printer 14 is now described in relation to FIGS. 8–10. Protrusion 334 of interface device 300 is aligned with cavity 342 of attachment feature 302, and body 304 is pushed in direction 160 towards carrier housing 70 by an assembly tool (not shown), inserting protrusion 334 of interface device 300 into cavity 342 of attachment feature 302. Once protrusion 334 is fully engaged with cavity 342, a rotation in rotational direction 350 is imparted to interface device 300 causing the hold-down flat 318 and hold-down aperture 320 of each wing 306 to engage respective ones of hooks 344, thereby retaining each wing 306 in close proximity to carrier housing 70. As rotation of interface device 300 continues, each wing 306 engages a corresponding ramped keeper 346, and deflects under the action of ramped keeper 346 as wing 306 passes over ramped keeper 346. Once wing 306 has passed over ramped keeper 346, wing 306 returns to a substantially undeflected state, and keeper face 348 of ramped keeper 346 acts against wing 306 to resist a rotation of interface device 300 in a direction opposite rotational direction 350 to retain interface device 300 in engagement with carrier housing 70.

Referring to FIG. 10, once body 304 is engaged with carrier housing 70, belt attach arm 200 is inserted in direction 218 into opening 330 of body 304. As assembly force is applied to belt attach arm 200 in direction 218, head 208 and beam 202 enter opening 330 aided by ramped surface 216, with opening 330 deflecting to receive head 208. Once head 208 has passed through opening 330, opening 330 returns to a substantially undeflected state, restraining beam 202 via barrel portion 338, resulting in an interference fit in interference dimension 224 (see FIG. 9). Retention shoulder 214 engages flat face surface 340 to resist movement or removal of belt attach arm 200 from body 104 in a direction 226 opposite to direction 218. Retention shoulder 220 engages beveled face surface 336 to resist movement or removal of belt attach arm 200 from opening 330 in direction 218. Thus, belt attach arm 200 is held by expansive forces exerted by beveled face surface 336 and flat face surface 340 against retention shoulder 220 and retention shoulder 214, respectively, resulting in an interference fit in interference dimension 222 (see FIG. 9). Clamp 210 of belt attach arm 200 is then attached to carrier belt 64.

Referring back to FIG. 8, body 304 and wings 306 are mounted to carrier housing 70 via wing mounting feature 316 and attachment feature 302. Wing mounting feature 316 of interface device 300 is in engagement with attachment feature 302 when interface device 300 is mounted to carrier housing 70.

Figure 11:
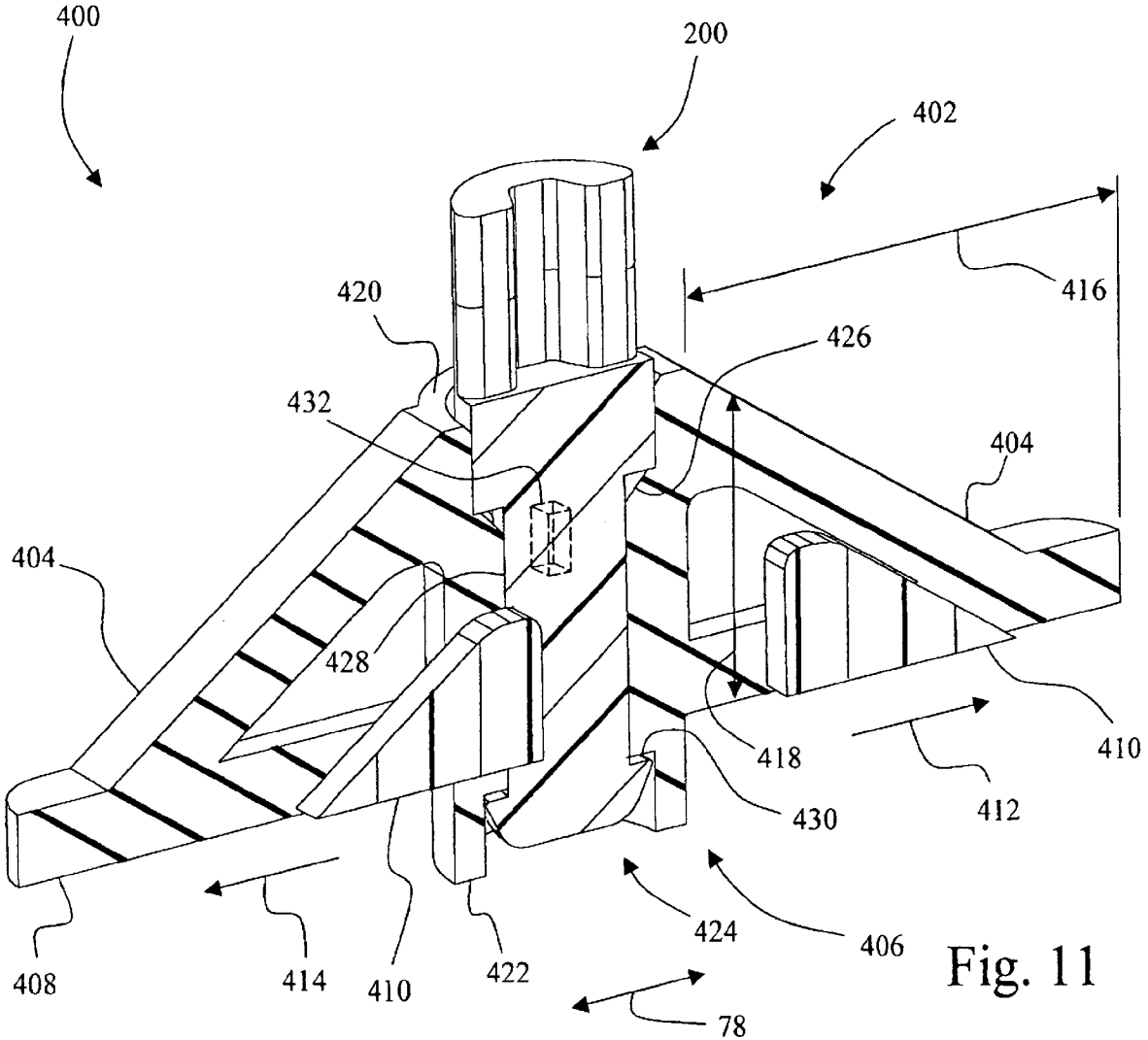
FIG. 11 is an exploded sectional view of an embodiment of the interface device of the present invention including an insert molded rigid elongate member.

Referring now to FIG. 11, another embodiment showing an interface device 400, suitable for use as interface device 74, is depicted. Some of the features and components of this embodiment, in particular, belt attach arm 200, are common with the previously described embodiments.

As shown in FIG. 11, interface device 400 includes a body 402 and belt attach arm 200. Body 402 has two wings 404, a central portion 406, and a base 408. A rigid elongate member 410 is insert molded into each wing 404. A first of wing 404 extends in a first direction 412 from central portion 406, and a second of wing 404 extends from central portion 406 in a second direction 414 opposite to direction 412. Each of wing 404 and central portion 406 extend from base 408. Each wing 404 is defined by a span 416 and a chord length 418. Span 416 extends in bi-directional scanning direction 78. Chord length 418 is substantially perpendicular to span 416 and varies in magnitude along span 416 of wing 404. As shown, span 416 is greater in magnitude than chord length 418.

Central portion 406 of body 402 has an exterior surface 420 spaced apart from an exterior surface 422, and an opening 424. Opening 424 extends between exterior surface 420 and exterior surface 422. Within opening 424 are a beveled face surface 426, a barrel portion 428, a flat face surface 430, and a keyway 432. Barrel portion 428 extends between beveled face surface 426 and flat face surface 430. Keyway 432 extends along the longitudinal dimension of barrel portion 428.

Belt attach arm 200 is assembled with body 402 in a manner similar to that described with respect to the previously disclosed embodiments. The attachment of interface device 400 with carrier housing 70 may be made by an appropriate one of the attachment structures previously described. For example, interface device 400 may include a base mounting feature, similar to base mounting feature 116, for engaging and mounting to attachment feature 102. Alternatively, interface device 400 may include a wing mounting feature, similar to wing mounting feature 316, for engaging and mounting to attachment feature 302.

Figure 12:
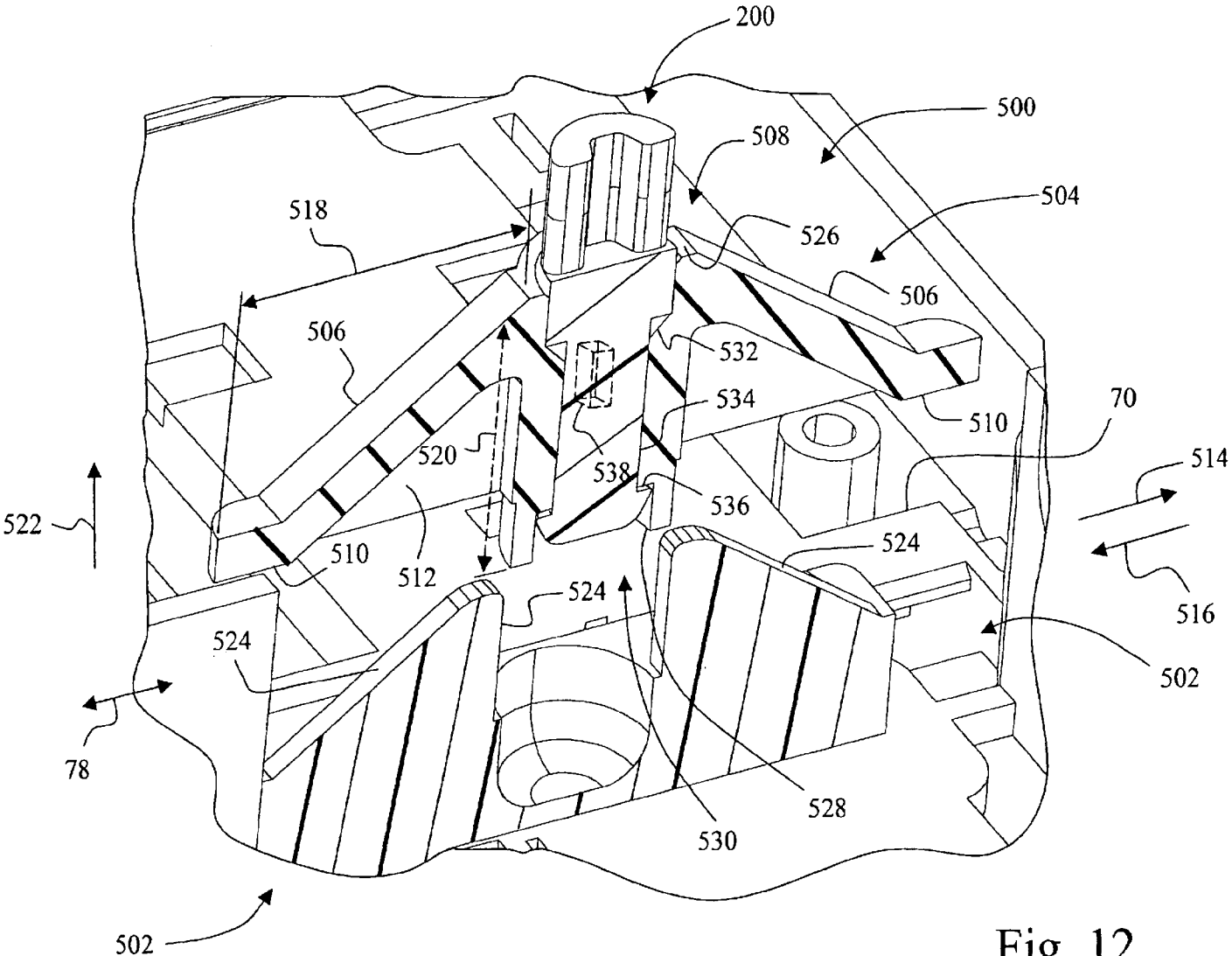
FIG. 12 is an exploded sectional view of an embodiment of the interface device of the present invention with an attachment feature including a rigid elongate member.

Referring now to FIG. 12, yet another embodiment showing an interface device 500, suitable for use as interface device 74, and an attachment feature 502, suitable for use as attachment feature 72, is depicted. As shown in FIG. 12, interface device 500 includes a body 504 and belt attach arm 200. Some of the features and components of this embodiment, in particular, belt attach arm 200, are common with the previously described embodiments.

Body 504 has two wings 506, a central portion 508, and a base 510. Each wing 506 includes a wing slot 512. A first of wing 506 extends in a first direction 514 from central portion 508, and a second of wing 506 extends from central portion 508 in a second direction 516 opposite to direction 514. Each of wing 506 and central portion 508 extend from base 510. Each wing 506 is defined by a span 518 and a chord length 520. Span 518 extends in bi-directional scanning direction 78. Chord length 520 is substantially perpendicular to span 518 and varies in magnitude along span 518 of wing 506. As shown, span 518 is greater in magnitude than chord length 520. Wing slot 512 extends in a direction 522 corresponding to chord length 520.

Attachment feature 502 includes rigid elongate members 524, each being respectively received in a corresponding wing slot 512. Rigid elongate member 524 is affixed to wings 510, for example, by an interface fit, or adhesive. Alternatively, rigid elongate member 524 is insert molded into wings 506, with the attachment of rigid elongate member 524 being made to carrier housing 70.

Central portion 508 of body 504 has an exterior surface 526 spaced apart from an exterior surface 528, and an opening 530. Opening 530 extends between exterior surface 526 and exterior surface 528. Within opening 530 are a beveled face surface 532, a barrel portion 534, a flat face surface 536, and a keyway 538. Barrel portion 534 extends between beveled face surface 532 and flat face surface 536. Keyway 538 extends along the longitudinal dimension of barrel portion 534.

Belt attach arm 200 is assembled with body 504 in a manner similar to that described with respect to the previously disclosed embodiments. The attachment of interface device 500 with carrier housing 70 may be made by an appropriate one of the attachment structures previously described. For example, rigid elongate member 524 may include a base mounting feature, similar to base mounting feature 116, and attachment feature 502 might be similar to attachment feature 102, for engaging and mounting to. Alternatively, interface device 500 may include a wing mounting feature, similar to wing mounting feature 316, for engaging and mounting to attachment feature 302.

The operation of the present invention is now described with reference to the embodiments previously described. During operation of ink jet printer 14, a torque ripple is developed in printhead carrier motor 62. The torque ripple is a typical characteristic of certain electric motors, and varies in magnitude with the type of motor used. Generally, the larger and more expensive the motor, the lower the torque ripple amplitude. Conversely, smaller, low cost motors tend to produce a torque ripple with higher magnitude. The frequencies associated with torque ripple are quite low, in the range of about 50 Hz to 200 Hz. As ink jet printer 14 is printing, the printhead is scanning across the recording medium under the power of carrier motor 62. Torque ripple generated by carrier motor 62 creates torque fluctuations and vibrations that are transmitted through carrier drive system 36, producing longitudinal vibrations along carrier belt 64 in bi-directional scanning direction 78 and transverse standing wave vibrations in a direction 80 (see FIGS. 3 and 8) in carrier belt 64. These vibrations are transmitted from carrier belt 64 to clamp 210 of belt attach arm 200, and into body 104, 304, 402, 504 (see FIGS. 4, 11 and 12).

Body 104, 304, 402, 504 is made of a resilient material having a high internal damping coefficient, such as, for example, rubber. The composition of body 104, 304, 402, 504 is relatively soft, having a hardness in the range of, for example, 35 to 55 durometer, as measured on the Shore A scale. The hardness of body 104, 304, 402, 504 is selected to provide a low enough natural frequency of body 104, 304, 402, 504 to filter and damp the low frequencies associated with torque ripple. The shape of wings 110, 306, 404, 506 is designed to provide adequate support in bi-directional scanning direction 78, in order to prevent degradation of the position control response of printhead carrier 40. In addition, interference dimensions 222 and 224 associated with belt attach arm 200 are selected to provide support in bi-directional scanning direction 78, and paper feed direction. Dimensions 222 and 224 are also selected to provide a large contact area between beam 202 of belt attach arm 200 and opening 130, 330, 424, 530 of body 104, 304, 402, 504 to transmit vibrational energy of vibrations in carrier belt 64, that are in a direction parallel to bi-directional scanning direction 78, to body 104, 304, 402, 504. Body 104, 304, 402, 504 serves to isolate and damp the vibrations in order to reduce the amount of vibrations that are transmitted to printhead carrier 40. While the shape of wings 110, 306, 404, 506 provide support to body 104, 304, 402, 504 in bi-directional scanning direction 78, it is readily understood that the geometry of body 104, 304, 402, 504 provides less such support in other directions, such as, for example, direction 80, thus permitting more freedom of movement in direction 80, allowing body 104, 304, 402, 504 to damp standing wave vibrations in carrier belt 64.

With respect to the embodiments of FIGS. 11 and 12, additional support in bi-directional scanning direction 78 is provided to body 402, 504 in comparison to that of bodies 104, 304, by including rigid elongate members 410, 524, while still allowing limited freedom of movement in direction 80, allowing body 402, 504 to damp standing wave vibrations in carrier belt 64.

Referring now to FIG. 2, it is seen that interface device 100, 300, 400, 500 provides a reduction in vibration transmitted to printhead carrier 40 in comparison to a hard attachment. For example, the transmissibility of vibration may be reduced by approximately 30 dB at approximately 130 Hz relative to a hard attachment. However, it is to be understood that FIG. 2 is a generalized plot, and that the actual transmissibility reduction will depend upon the particular application, including design parameters such as, for example, the mass, center of gravity, mounting and attachment of the particular printhead carrier 40, and the torque ripple and frequency characteristics of carrier drive system 36 including carrier motor 62, that are used in ink jet printer 14. The design of interface device 100, 300, 400, 500 including the size, shape, hardness, and material selection of body 104, 304, 402, 504 and belt attach arm 200, will vary in accordance with such design parameters, in order to produce a desirable transmissibility reduction at the necessary frequency.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a carrier housing having an attachment feature;

a carrier belt to transmit a translation to said carrier housing in a bi-directional scanning direction; and an interface device interposed between and coupled to both said carrier housing and said carrier belt, said interface device including a body having a wing and a base, said wing being defined by a span and by a chord length, wherein at least one of said wing and said base is mounted via said attachment feature to said carrier housing, and wherein said span extends in said bi-directional scanning direction, and said chord length is substantially perpendicular to said span, wherein said chord length varies in magnitude along said span of said wing, wherein said interface device is configured using a material, wherein said material, said chord length and said span are selected to filter at least one predetermined frequency of vibration while maintaining a sufficient stiffness to provide control of said carrier housing in said bi-directional scanning direction, said base having a base mounting feature in engagement with said attachment feature when said interface device is mounted to said carrier housing, said base mounting feature including an extension of said base configured to engage said attachment feature, said extension having a ramped keeper head, said ramped keener head having a keeper face, said attachment feature including an aperture, a slot extending radially outward from said aperture, and a retention face adjacent to said aperture and said slot, wherein a translation of said interface device in a first translational direction results in said extension of said base being slidably received into said aperture and said slot under the aid of said ramped keeper head, said keeper face of said ramped keeper head engaging said retention face to resist a removal of said interface device from engagement with said carrier housing.

2. The imaging apparatus of claim 1, wherein said base mounting feature has an interference fit in at least two dimensions with said attachment feature.

3. The imaging apparatus of claim 1, wherein said slot includes two slots extend radially outward from said aperture about one hundred eighty degrees apart from each other, said two slots having a common axis substantially parallel to said bi-directional scanning direction.

4. The imaging apparatus of claim 1, wherein said interface device includes a belt attach arm having:

a beam having a first end and a second end;

a head formed at said first end; and a clamp for attachment to said carrier belt formed at said second end.

5. The imaging apparatus of claim 4, said belt attach arm having a key, and said body having a keyway configured for receiving said key, wherein said keyway receives said key to resist a rotation of said belt attach arm relative to said body.

6. An imaging apparatus, comprising:

a carrier housing having an attachment feature;

a carrier belt to transmit a translation to said carrier housing in a bi-directional scanning direction; and an interface device interposed between and coupled to both said carrier housing and said carrier belt, said interface device including a body having a wing and a base, said wing being defined by a span and by a chord length, wherein at least one of said wing and said base is mounted via said attachment feature to said carrier housing, and wherein said span extends in said bi-directional scanning direction, and said chord length is substantially perpendicular to said span, wherein said chord length varies in magnitude along said span of said wing, wherein said interface device is configured using a material, and wherein said material said chord length and said span are selected to filter at least one predetermined frequency of vibration while maintaining a sufficient stiffness to provide control of said carrier housing in said bi-directional scanning direction, said base having a base mounting feature in engagement with said attachment feature when said interface device is mounted to said carrier housing, said interface device further including a belt attach arm having a beam having a first end and a second end, a head formed at said first end, and a clamp for attachment to said carrier belt formed at said second end, said body having an opening, wherein said head and said beam are inserted in a first direction into said opening, said head resisting removal of said beam from said opening.

7. The imaging apparatus of claim 6, wherein said belt attach arm has an interference fit in at least two dimensions with said body.

8. An imaging apparatus, comprising:

a carrier housing having an attachment feature;

a carrier belt to transmit a translation to said carrier housing in a bi-directional scanning direction; and an interface device interposed between and coupled to both said carrier housing and said carrier belt, said interface device including a body having a wing and a base, said wing being defined by a span and by a chord length, wherein at least one of said wing and said base is mounted via said attachment feature to said carrier housing, and wherein said span extends in said bi-directional scanning direction, and said chord length is substantially perpendicular to said span, said interface device including a belt attach arm having a beam having a first end and a second end, a head formed at said first end, and a clamp for attachment to said carrier belt formed at said second end, said body having an opening, wherein said head and said beam are inserted in a first direction into said opening, said head resisting removal of said beam from said opening.

9. The imaging apparatus of claim 8, wherein said belt attach arm has an interference fit in at least two dimensions with said body.

10. The imaging apparatus of claim 8, wherein said span is greater in magnitude than said chord length.

11. The imaging apparatus of claim 8, said chord length of said wing varying linearly in magnitude along said span of said wing, such that said wing has a substantially triangular shape.

12. An imaging apparatus, comprising:

a carrier housing including an attachment feature;

a carrier belt to transmit a translation to said carrier housing in a bi-directional scanning direction; and an interface device interposed between and coupled to both said carrier housing and said carrier belt, wherein said interface device includes:

a body having an opening; and a belt attach arm having:

a beam having a first end and a second end;

a head formed at said first end; and a clamp for attachment to said carrier belt formed at said second end, wherein said beam and said head are slidably received into said opening.

13. The imaging apparatus of claim 12, wherein said head and said beam are inserted in a first direction into said opening, said head resisting removal of said beam from said opening.

14. The imaging apparatus of claim 12, wherein said belt attach arm has an interference fit with said body.

15. The imaging apparatus of claim 12, said body having a wing and a base, said wing being defined by a span and a chord length, wherein at least one of said wing and said base is mounted via said attachment feature to said carrier housing, and wherein said chord length is substantially perpendicular to said span.

16. The imaging apparatus of claim 15, wherein said chord length varies in magnitude along said span of said wing.

17. The imaging apparatus of claim 12, said belt attach arm having a key, and said body having a keyway configured for receiving said key, wherein said keyway receives said key to resist a rotation of said belt attach arm relative to said body.

18. An interface device to isolate vibration for use in an imagine apparatus, comprising:

a body, said body including:

a central portion having a first surface spaced apart from a second surface, and having an opening extending through said body between said first surface and said second surface;

a first wing extending in a first direction from said central portion;

a second wing extending in a second direction opposite said first direction from said central portion;

each of said first wing and said second wing being defined by a span and a chord length, wherein said chord length extends in a direction substantially perpendicular to said span, wherein said extending of said opening is parallel to said chord length; and a belt attach arm, said belt arm including;

a beam having a first end and a second end;

a head formed at said first end, said head having a first retention shoulder and a ramped surface, said head narrowing at said ramped surface in a third direction away from said retention shoulder; and a second retention shoulder formed near said second end, wherein said head and said beam are inserted in said third direction into said opening under the aid of said ramped surface of said head, said first retention shoulder of said head engaging a first retention surface of said body to resist movement of said belt attach arm in a fourth direction opposite said third direction, and said second retention shoulder engaging a second retention surface to resist movement of said belt attach arm in said third direction.

19. The interface device of claim 18, wherein said belt attach arm has an interference fit in at least two dimensions with said body.

20. An interface device to isolate vibration for use in an imagine apparatus, comprising:

a body, said body including:

a central portion having a first surface spaced apart from a second surface, and having an opening extending through said body between said first surface and said second surface;

a first wing extending in a first direction from said central portion;

a second wing extending in a second direction opposite said first direction from said central portion;

each of said first wing and said second wing being defined by a span and a chord length, wherein said chord length extends in a direction substantially perpendicular to said span, wherein said extending of said opening is parallel to said chord length; and a belt attach arm having a key, and said body having a keyway configured for receiving said key, wherein said keyway receives said key to resist a rotation of said belt attach arm relative to said body.

21. The interface device of claim 20, wherein said span is greater in magnitude than said chord length.

22. The interface device of claim 20, said chord length of each said first wing and said second wing varying linearly in magnitude along said span of said wing, such that said wing has a substantially triangular shape.

* * * * *